US008827489B2

(12) United States Patent
Li et al.

(10) Patent No.: US 8,827,489 B2
(45) Date of Patent: Sep. 9, 2014

(54) LED BULB ADOPTING ISOLATED FLUORESCENT CONVERSION TECHNOLOGY

(75) Inventors: Bingqian Li, Shenzhen (CN); Hongcun Peng, Shenzhen (CN); Weiguo Wang, Shenzhen (CN)

(73) Assignee: Shenzhen CGX LED Lightening Industrial Co., Ltd., Shenzhen (CN)

( * ) Notice: Subject to any disclaimer, the term of this patent is extended or adjusted under 35 U.S.C. 154(b) by 601 days.

(21) Appl. No.: 12/942,032

(22) Filed: Nov. 9, 2010

(65) Prior Publication Data

US 2011/0156586 A1 Jun. 30, 2011

(30) Foreign Application Priority Data

Dec. 28, 2009 (CN) ..... 2009 1 0215261

(51) Int. Cl.

| | |
|---|---|
| ***F21V 1/00*** | (2006.01) |
| ***F21V 11/00*** | (2006.01) |
| ***F21S 4/00*** | (2006.01) |
| ***F21V 21/00*** | (2006.01) |
| ***H01R 33/00*** | (2006.01) |

(52) U.S. Cl.

USPC ..... 362/235; 362/249.02; 362/650

(58) Field of Classification Search

None

See application file for complete search history.

(56) References Cited

U.S. PATENT DOCUMENTS

| | | | | |
|---|---|---|---|---|
| 7,244,051 | B2 * | 7/2007 | Bewig et al. | 362/345 |
| 7,267,787 | B2 * | 9/2007 | Dong et al. | 252/301.4 F |
| 7,573,071 | B2 * | 8/2009 | Chang | 257/81 |
| 7,588,351 | B2 * | 9/2009 | Meyer | 362/294 |
| 7,701,055 | B2 * | 4/2010 | Wu et al. | 257/712 |
| 8,115,217 | B2 * | 2/2012 | Duong et al. | 257/88 |
| 2003/0230751 | A1 * | 12/2003 | Harada | 257/80 |
| 2008/0218993 | A1 * | 9/2008 | Li | 362/84 |
| 2009/0086492 | A1 * | 4/2009 | Meyer | 362/294 |
| 2010/0302789 | A1 * | 12/2010 | Li et al. | 362/373 |
| 2011/0104935 | A1 * | 5/2011 | Kitamura et al. | 439/485 |

* cited by examiner

*Primary Examiner* — Douglas W Owens
*Assistant Examiner* — Dedei K Hammond
(74) *Attorney, Agent, or Firm* — Muncy, Geissler, Olds & Lowe, P.C.

(57) ABSTRACT

An LED bulb is provided which includes a white light conversion film, a metal shell, a blue or purple or UV LED light source, an insulation connecting component, and a lamp holder. The metal shell includes an upper step and a lower step in an inner surface thereof. The white light conversion film is disposed on the upper step. The LED light source is disposed on the lower step. The lamp holder is connected to a bottom of the metal shell via the insulation connecting component.

17 Claims, 1 Drawing Sheet

LED BULB ADOPTING ISOLATED FLUORESCENT CONVERSION TECHNOLOGY

BACKGROUND OF THE INVENTION a) Field of the Invention

This invention relates to one light source, and specifically relates to a kind of LED bulb.

b) Description of the Prior Art

LED lighting source is called as "a second lighting technology revolution after Thomas Edison's bulb" due to its high luminous efficiency, full-solid state, and long service life without mercury pollution. Prior art white LED bulb is manufactured by assembling packaged white LED onto a circuit board such that a light source is formed. The main drawbacks of this technology are:

It is difficult to control the phosphor uniformity when applying phosphor powder to a blue LED chip, which leads to the poor brightness uniformity of the finished white LED lighting source, and also it is difficult to adjust the color temperature of white LED lamps after the finished products are formed.

The phosphor directly contacts with the blue LED chip. Heat produced by blue LED chip can result in the high operation temperature of the phosphor, which speed up the aging of the phosphor, and affect the service life of the white LED lamps.

A great deal of organic material is used on pathway of light beam radiation out of the source, such as the lens of organic material, reflector cup of organic material. In the process of long-term use, the color change of organic material will seriously affect the luminous efficiency.

The sealed LED devices can form lots of dazzling light spots in the light source, which fails to suit people's habits. Addition of scattering materials into surface of lighting source partially overcomes dazzling problem caused by point light source. However, this technology will lead to a sharp decline of luminous efficiency of LED bulb and thus affect the promotion of the use of LED light sources.

SUMMARY OF THE INVENTION

In view of drawbacks of prior technology, the purpose of the invention is to provide a kind of LED bulb to eliminate above drawbacks such as inefficiency of fluorescent light, serious light attenuation and difficulty to control uniformity of light color, and dazzling problem of light-emitting light source of point light sources array, etc.

To achieve above purposes, an LED bulb is provided which includes a white light conversion film, a metal shell, a blue or purple or UV (ultraviolet) LED light source, an insulation connecting component, and a lamp holder. The metal shell includes an upper step and a lower step in an inner surface thereof. The white light conversion film is disposed on the upper step. The LED light source is disposed on the lower step. The lamp holder is connected to a bottom of the metal shell via the insulation connecting component.

Preferably, the white light conversion film is fixed onto the upper step via adhesive; the LED light source is installed to the lower step via the thermal conductive adhesive.

Preferably, the white light conversion film includes a transparent medium and a layer of white LED phosphor film which is coated on the surface of the transparent medium by printing, powder sedimentation, spray, and evaporation process. Material such as glass, acrylic, PMMA and so on can be used to form the transparent medium.

Preferably, the inner surface of the metal shell located between the upper step and lower step also includes a reflect coating layer.

Preferably, the metal shell is coated on its outer surface with a thermal radiation layer.

Preferably, the blue or purple, or UV LED light source is a blue or purple, or UV LED chip array bonding on the metal circuit board.

Preferably, one or more protrusions are formed on the surface of the above mentioned chip array by sealed colloid.

Preferably, the blue or purple, or UV LED light source can be an array of a plurality of LED devices formed on a metal circuit board.

Preferably, a built-in driving power supply is disposed in the closed space defined by the insulation connection member, lamp holder, metal shell, and the LED light source together.

Compared to prior art, the beneficial effects of this invention are presented as follows.

The blue (purple, ultraviolet) light emitted by the LED is directly transformed into white light by the white LED phosphor film, thereby forming a uniform surface light source.

An isolated conversion method is employed to solve the existing drawback of difficult control of color uniformity of LED light source. Furthermore, the production process is simplified.

There is a distance between the phosphor film and the LED chips, and therefore, heat generated by the chips will not affect the conversion efficiency of phosphor and its life.

Direct adoption of COB technology to produce LED chip array on the metal circuit board makes it possible to conduct the heat of the LED chips to the metal shell via the metal circuit board, hence reducing the thermal resistance of the system and ensuring the device to operate at a relative lower temperature, and finally improving the reliability and lifespan of the light source.

There are one or more protrusions formed by sealed colloid on the surface of LED chip array to improve the light-emitting efficiency of the chip.

BRIEF DESCRIPTION OF THE DRAWINGS

The present invention will be apparent to those skilled in the art by reading the following description when taken in conjunction with the accompanying drawings, in which.

DETAILED DESCRIPTION OF THE PREFERRED EMBODIMENTS

The invention is described below in further detail in conjunction with the accompanying drawings and embodiment of the invention.

Figure 1:
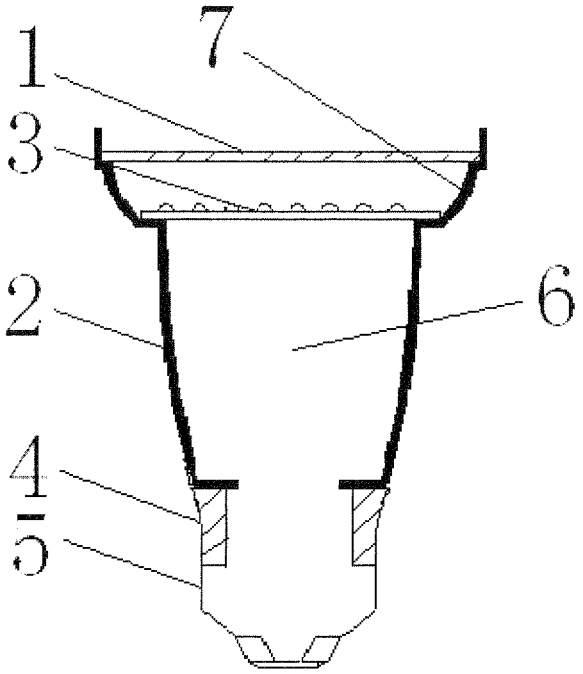
FIG. 1 shows the schematic structure of an LED bulb adopting isolated fluorescent conversion technology according to a preferred embodiment of the invention.
Figure 2:
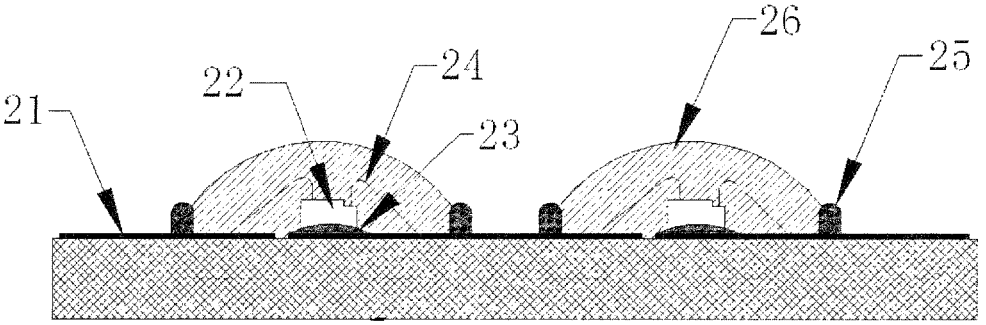
FIG. 2 shows the schematic structure of an LED light source in FIG. 1.

Referring to FIG. 1 and FIG. 2, and LED bulb according to a preferred embodiment of the invention includes a white light conversion film 1, a metal shell 2, a blue or purple or UV (ultraviolet) LED light source 3, an insulation connecting component 4, and a lamp holder 5. The metal shell 2 includes an upper step and a lower step in an inner surface thereof. The upper step and the lower step are flat. The white light conversion film 1 is installed on the upper step of the metal shell 2 by adhesive, while the LED light source 3 is installed on the lower step adhesively by means of heat conductive adhesive.

The lamp holder 5 is fixed onto the bottom of the metal shell 2 via said insulation connecting component 4 to accomplish the insulation of electrical. A built-in driving power supply (not shown) is disposed in a closed space 6 formed by the insulation connection component 4, lamp holder 5, metal shell 2, and LED light source 3 together.

The white light conversion film 1 includes a transparent medium and a layer of white LED phosphor film which is coated on the surface of the transparent medium by printing, powder sedimentation, spray, or evaporation process. Materials such as glass, acrylic, PMMA and so on can be used to make the transparent medium. In this way, blue, purple or ultraviolet light emitted by the LED light source 3 is transformed into white light directly, thus producing a surface light source with high uniformity.

The metal shell 2 described by the invention is made by spinning or stamping process. The inner surface 7 between the two steps of the metal shell 2 also includes a reflect coating thereon to enhance the reflective effect. In addition, the above-mentioned metal shell 2 is also coated with thermal radiation materials to improve heat dissipation capacity of the bulb.

The LED light source 3 described above adopts COB (Chip on Board) technology to form a blue (purple, UV) LED chip array on the metal circuit board. Alternatively, the LED light source 3 can be an LED array formed by LED devices on circuit board. When adopting LED chip array in LED light source, there will be one or more protrusions formed by colloid on the surface of chip array to improve the efficiency of light-emitting.

Lamp holder 5 adopts normal lamp holders of various types. The size and shape are similar to traditional lamp, which can be used directly to replace traditional light source.

As shown in FIG. 2, the above-mentioned LED light source 3 includes a metal circuit board 21, a plurality of LED chips 22, high thermal conductivity adhesive 23, metal wire 24, steps 25, and spot silica gel 26. LED chips 22 are fixed on the metal circuit board 21 and are electrically interconnected with each other in series and/or parallel. High thermal conductivity adhesive 23 is applied to fix the LED chips 22 to the metal circuit board 21. The LED chips 22 and metal circuit board 21 are connected via metal wire 24. A step 25 is formed on the periphery of the LED chip 22. Inside the step 25, the silica gel 26 is dispensed so as to protect the LED chip and improve extraction efficiency of light source.

The blue (purple, ultraviolet) light emitted by the LED is directly transformed into white light by the white LED phosphor film 1, thereby forming a uniform surface light source.

There is a distance between the phosphor film 1 and the LED chips 22, and therefore, heat generated by the chip will not affect the conversion efficiency of phosphor and its life.

Direct adoption of COB technology to produce LED chip array on the metal circuit board 21 makes it possible to conduct the heat of the LED chips 22 to the metal shell 2 via the metal circuit board 21, hence reducing the thermal resistance of the system and ensuring the device to operate at a relative lower temperature, and finally improving the reliability and lifespan of the light source.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

We claim:

1. An LED bulb comprising: a metal shell including an upper step and a lower step in an inner side thereof; a LED light source fixed to a top surface of the lower step, wherein the LED light source is configured to emit a first type of light, wherein the LED light source comprises a circuit board and a first LED chip over the circuit board; and a light conversion film fixed to a top surface of the upper step and over the LED light source, wherein the light conversion film is configured to transform the first type of light into a second type of light; wherein the first type of light comprises blue or purple or UV light.

2. The LED bulb of claim 1 further comprising a first adhesive fixing the light conversion film to the top surface of the upper step and a second adhesive fixing the LED light source to the top surface of the lower step.

3. The LED bulb of claim 1, wherein the light conversion film includes a transparent medium and a layer of white LED phosphor film on the transparent medium.

4. The LED bulb of claim 1 further comprising a reflection layer at an inner surface of the metal shell between the upper step and lower step.

5. The LED bulb of claim 1 further comprising a thermal radiation layer at an outer surface of the metal shell.

6. The LED bulb of claim 1, wherein the LED light source further comprises a second LED chip over the circuit board.

7. The LED bulb of claim 1, wherein the LED light source has a metal wire connecting the first LED chip to the circuit board.

8. The LED bulb of claim 1, wherein the LED light source further comprises a gel on the first LED chip and the circuit board.

9. The LED bulb of claim 1 further comprising a driving power supply in the LED bulb.

10. The LED bulb of claim 8, wherein the LED light source further comprises a dam at a periphery of the first LED chip, wherein the gel is inside the dam.

11. The LED bulb of claim 8, wherein the gel comprises silica.

12. The LED bulb of claim 1, wherein the second type of light comprises white light.

13. The LED bulb of claim 3, wherein the transparent medium comprises glass.

14. The LED bulb of claim 3, wherein the transparent medium comprises acrylic.

15. The LED bulb of claim 1, wherein the LED light source adopts Chip on Board technology to form the first LED chip array on the metal circuit board for conducting the heat of the first LED chip to the metal shell via the metal circuit board.

16. The LED bulb of claim 15, wherein the LED light source is installed on the lower step by means of adopting heat conductive adhesive between the metal circuit board and the top surface of the lower step.

17. The LED bulb of claim 1, wherein the upper step and the lower step are flat.

* * * * *